US005357702A

United States Patent [19]

Van Tuil et al.

[11] Patent Number: 5,357,702

[45] Date of Patent: Oct. 25, 1994

[54] AIRLINE LUGGAGE MARKING STRIP

[75] Inventors: Ton Van Tuil, Arnhem; Jan Seegers, Zevenaar, both of Netherlands

[73] Assignee: Esselte Meto International GmbH, Heppenheim, Fed. Rep. of Germany

[21] Appl. No.: 49,846

[22] Filed: Apr. 20, 1993

[30] Foreign Application Priority Data

Apr. 24, 1992 [DE] Fed. Rep. of Germany ..... 4213495

[51] Int. Cl.[5] ..... G09F 3/10

[52] U.S. Cl. ..... 40/630; 40/299

[58] Field of Search ..... 40/630, 638, 594, 6, 40/316, 317, 325, 299; 156/187, 192

[56] References Cited

U.S. PATENT DOCUMENTS

| | | | |
|---|---|---|---|
| 4,065,343 | 12/1977 | Stumpe | 40/299 X |
| 4,247,361 | 1/1981 | Shaheen | 156/630 |
| 4,587,411 | 5/1986 | Obstfelder et al. | 235/437 |
| 4,716,068 | 12/1987 | Seifried et al. | 428/141 |
| 4,726,972 | 2/1988 | Instance | 40/299 X |
| 4,727,667 | 3/1988 | Ingle | 40/306 |
| 4,771,891 | 9/1988 | Sorensen et al. | 40/638 X |
| 4,792,246 | 12/1988 | Van Pelt | 400/120 |
| 4,805,531 | 2/1989 | Sarda | 101/488 |
| 4,817,310 | 4/1989 | Breen et al. | 40/299 |
| 4,867,828 | 9/1989 | McIntyre | 156/247 |
| 4,923,755 | 5/1990 | Witucki | 428/447 |
| 4,929,691 | 5/1990 | Fillmore et al. | 525/477 |
| 4,938,414 | 7/1990 | Lippert | 40/299 |
| 5,053,078 | 10/1991 | Koike et al. | 106/22 |
| 5,114,514 | 5/1992 | Landis | 156/153 |
| 5,121,131 | 6/1992 | Bouldin et al. | 346/1.1 |
| 5,159,353 | 10/1992 | Fasen et al. | 346/140 R |
| 5,183,696 | 2/1993 | Sanderson | 428/194 |

FOREIGN PATENT DOCUMENTS

| | | | |
|---|---|---|---|
| 537661 | 4/1993 | European Pat. Off. | 40/638 |
| 855746 | 2/1952 | Fed. Rep. of Germany . | |
| 7110538 | 9/1971 | Fed. Rep. of Germany . | |
| 7144620 | 3/1972 | Fed. Rep. of Germany . | |
| 9110080 | 11/1991 | Fed. Rep. of Germany . | |
| 9107460 | 1/1992 | Fed. Rep. of Germany . | |
| 9115228 | 5/1992 | Fed. Rep. of Germany . | |

*Primary Examiner*—Kenneth J. Dorner
*Assistant Examiner*—Joanne Silbermann
*Attorney, Agent, or Firm*—Nils H. Ljungman & Associates

[57] ABSTRACT

This invention relates to a marking strip for identifying airline luggage with a main part and a control section adjacent to it in the longitudinal direction, separated by a parting cut, whereby the control section and an adjacent area of the main part have an adhesive coating on the reverse side which is covered by a silicone-coated backing strip, which is firmly connected to the main part and is interrupted at some distance from the parting cut of the label strip at a parting line. The backing strip is thereby glued in one step directly during joining to the marking strip to a strongly adhesive area formed on the backing strip. There is no need for an additional coating to fasten the backing strip.

20 Claims, 6 Drawing Sheets

AIRLINE LUGGAGE MARKING STRIP

BACKGROUND OF THE INVENTION

1. Field of the Invention:

This invention relates to a marking strip with a main part and a control section adjacent to the main part in a longitudinal direction and separated by a parting cut, whereby the control section and an area of the main part adjacent thereto have an adhesive coating on the reverse side. The adhesive coating is covered by a silicone-coated backing strip which is firmly connected to the main part and is interrupted at some distance from the parting cut of the label strip at a parting line. In known applications, such marking strips are used, for example, for identifying airline luggage.

2. Background Information:

When a known marking strip is used, first the control section is torn off the main part. On the control section, a portion of the adhesive coating is then exposed, because the parting line in the cover strip is offset toward the control section in relation to the parting cut. The control section can thus be stuck directly onto the airline ticket, without having to remove the remainder of the backing strip. Then the main part is generally looped around a suitcase handle, for example, and the backing strip is grasped on the projecting end, and is pulled toward the suitcase handle. Since the backing strip, on its end facing the suitcase handle, is firmly connected to the main part by a holding strip glued from behind, it can be folded over to expose the adhesive coating only toward the suitcase handle, before the main part is glued together with the reverse side of both its ends glued to one another. Essentially, the folded backing strip must therefore also be looped around the suitcase handle, or it must project laterally from the loop formed by the main part. Essentially, the reason the backing strip remains fastened to the main part is so that the backing strip is not left behind at the workplace, i.e. at the airline ticket counter in the current example. It is desirable that a situation of leaving behind backing strips be prevented under all circumstances, because the silicone-coated backing strips tend to present a serious hazard if they are strewn around on the floor. It is very easy to slip on them and fall. Numerous accidents have occurred when marking strips which have completely removable backing strips are used. The fastening of the backing strip to the main part is therefore a highly desirable requirement in this application.

However, the manufacture of the known marking strips tends to be very complex, time-consuming and expensive. To fasten the backing strip, the manufacturing process requires an additional step, which must also usually be performed on the reverse side. After the marking strip has been provided with the adhesive coating and combined with the backing, an additional adhesive strip must generally be glued on from the reverse side over the end of the backing on the main part. This also essentially results in different thicknesses of the marking strip. Since the marking strips generally have to be printed before they are used, this difference in thickness tends to cause significant problems in the printer, and often results in unusable printing quality at the transitions. The unprinted marking strips are also generally stored in a roll. They are then wound up continuously and separated by a perforation. The difference in thickness also tends to cause problems here.

OBJECT OF THE INVENTION

The object of the invention is to refine a marking strip of the type described above so that the fastening of the backing to the marking strip can be done directly in one process during the joining of the two parts, and so that the thickness of the marking strip is not uneven, on account of the additional layer formed by fastening means.

SUMMARY OF THE INVENTION

This object is achieved by the invention in that the backing, in the vicinity of the main part, has a strongly adhesive region on its side facing the main part. Such a strongly adhesive region is essentially most easily created by an interruption of the silicone coating, or if, for manufacturing reasons, the silicone coating must be applied continuously, the silicone layer in the strongly adhesive area can essentially simply be neutralized or covered with an adhesive coating. For neutralization, the silicone coating can essentially be etched, corona-treated or roughened. For covering with an adhesive coating, the silicone coating can essentially be printed with an oxidizing printing ink. The particular advantage of the solution proposed by the invention is that the firm connection of the backing to the main part of the marking strip is achieved directly by means of the adhesive coating on the reverse side of the main part. The backing can essentially thereby only be pulled off up to the strongly adhesive region, without the requirement for additional fastening elements. The thickness of the marking strip thereby remains practically unaffected.

From a manufacturing point of view, it is favorable if the strongly adhesive region extends in the longitudinal direction over the entire width of the backing. The backing can thus essentially be continuously prefabricated at a right angle to the main direction of the marking strip, without the need for interruptions in the fabrication direction for the application of the silicone coating or during processing, or finishing, for the strongly adhesive area.

For use of the marking strip as a luggage identification label, it is advantageous if the strongly adhesive area is located in the longitudinal direction such that between the strongly adhesive area and the parting out, a narrow section pointing toward the control section is formed as a result of the section which repels the silicone coating, and a long, adhesive-repellent section is formed in the opposite direction. The longitudinal extension of the long, adhesive-repellent section is approximately equal to the length of the strongly adhesive area. The ends of the backing strip can then be folded on both sides toward the strongly adhesive area, and the main part can be firmly glued in the area exposed by the long repellent section immediately behind the suitcase handle, while the ends, projecting banner-like from the suitcase handle, can be neatly fixed by the area exposed by the narrow repellent section. The entire backing strip of the main part can thus be enclosed between the two glued areas. Essentially, no parts of the backing strip need to be looped around the suitcase handle; nor do there tend to be any unsightly projecting ends of the backing strip.

A small area of the adhesive coating on the main part can be automatically exposed when the control section is torn off, if the parting line in the backing strip intersects the parting cut between the main part and the control section at least once. With such a configuration, such a small area with an adhesive coating can be exposed both on the control section and on the main part. It is particularly favorable if the parting line begins on the lateral edge of the marking strip behind the main part, at right angles to the marking strip, then intersects the parting out in a curve, and runs parallel to the parting cut behind the control section, and then, before reaching the other lateral edge, once again crosses the parting cut for the main part in a curve. Thus, the adhesive coating can be exposed in the center on the control section, and on the two corners on the main part. The ends, which project like banners after the strip has been applied to the suitcase handle, can thus essentially be cleanly glued on the corners. The corners essentially do not project untidily, and tend not to form potential starting points for tearing. This tends not to be as important on the control section, because the control section is glued into the flat ticket folder, and is exposed to practically no mechanical stress.

The details of the present invention summarized hereinabove are discussed more fully hereinbelow, with reference to the accompanying drawings.

In summary, one aspect of the invention resides broadly in a method of marking checked airline luggage by means of an airline luggage marking strip, by wrapping the marking strip around a handle of the airline luggage, the method comprising the steps of: providing an airline luggage marking strip by way of the following steps: providing a main strip for being wrapped around the handle of the airline luggage, the main strip comprising a first surface on a first side of the main strip and a second surface on a second side of the main strip, the first side of the main strip being disposed opposite the second side of the main strip; providing an auxiliary strip for being partially removed to permit the wrapping of the main strip around the handle of the airline luggage, the auxiliary strip comprising a first surface on a first side of the auxiliary strip and a second surface on a second side of the auxiliary strip, the first side of the auxiliary strip being disposed opposite the second side of the auxiliary strip; configuring the first surface of the auxiliary strip to have a first portion and a second portion; configuring the first surface of the main strip to have a first portion and a second portion; providing an adhesive for attaching the first portion of the main strip to the first portion of the auxiliary strip; directly attaching the first portion of the main strip to the first portion of the auxiliary strip by means of the adhesive; providing first coating means and disposing the first coating means on at least one of: the first surface of the main strip, and the first surface of the auxiliary strip, to selectively permit, along the second portion of the auxiliary strip and the second portion of the main strip, separation of the second portion of the auxiliary strip and the second portion of the main strip from each other; configuring the first coating means to provide at least some adhesion between the second portion of the auxiliary strip and the second portion of the main strip; configuring the main strip to have a third portion separate from the first portion of the main strip and the second portion of the main strip; disposing the first coating means on at least one of the second portion of the main strip and the third portion of the main strip; configuring the first coating means to attach the second portion of the main strip and the third portion of the main strip to each other; and configuring the adhesive to provide a substantially stronger degree of adhesion between the first portion of the main strip and the first portion of the auxiliary strip than is provided by the first coating means between the second portion of the main strip and the second portion of the auxiliary strip; providing a substantially stronger degree of adhesion between the first portion of the main strip and the first portion of the auxiliary strip than between the second portion of the main strip and the second portion of the auxiliary strip; the method further comprising the additional steps of: separating the second portion of the auxiliary strip and the second portion of the main strip from each other along the second portion of the auxiliary strip and the second portion of the main strip; wrapping the main strip around the handle of the airline luggage; and the step of wrapping comprising the step of attaching the second portion of the main strip and the third portion of the main strip to each other by means of the first coating means.

Another aspect of the invention resides broadly in an airline luggage marking strip for marking checked airline luggage by being wrapped around a handle of the luggage, the marking strip comprising: a main strip for being wrapped around the handle of the airline luggage, the main strip comprising a first surface on a first side of the main strip and a second surface on a second side of the main strip, the first side of the main strip being disposed opposite the second side of the main strip; an auxiliary strip for being at least partially removed to permit the wrapping of the main strip around the airline luggage handle, the auxiliary strip comprising a first surface on a first side of the auxiliary strip and a second surface on a second side of the auxiliary strip, the first side of the auxiliary strip being disposed opposite the second side of the auxiliary strip; the first surface of the auxiliary strip having a first portion and a second portion; the first surface of the main strip having a first portion and a second portion; an adhesive attaching the first portion of the main strip to the first portion of the auxiliary strip, the first portion of the auxiliary strip being directly attached to the first portion of the main strip by means of the adhesive; first coating means, disposed on at least one of: the first surface of the main strip, and the first surface of the auxiliary strip, for selectively permitting, along the second portion of the auxiliary strip and the second portion of the main strip, separation of the second portion of the auxiliary strip and the second portion of the main strip from each other; the first coating means providing at least some adhesion between the second portion of the auxiliary strip and the second portion of the main strip; the main strip having a third portion separate from the first portion of the main strip and the second portion of the main strip; the first coating means being disposed on at least one of the second portion of the main strip and the third portion of the main strip, the first coating means being configured to attach the second portion of the main strip and the third portion of the main strip to each other such that the main strip is disposed around the handle of the airline luggage; and the adhesive providing a substantially stronger degree of adhesion between the first portion of the main strip and the first portion of the auxiliary strip than is provided by the first coating means between the second portion of the main strip and the second portion of the auxiliary strip.

Yet another aspect of the invention resides broadly in a marking strip for the identification of an object, such as luggage, the strip comprising: a main strip, the main strip comprising a first surface on a first side of the main strip and a second surface on a second side of the main strip, the first side of the main strip being disposed opposite the second side of the main strip; an auxiliary strip, the auxiliary strip comprising a first surface on a first side of the auxiliary strip and a second surface on a second side of the auxiliary strip, the first side of the auxiliary strip being disposed opposite the second side of the auxiliary strip; the first surface of the auxiliary strip having a first portion and a second portion; the first surface of the main strip having a first portion and a second portion; an adhesive attaching the first portion of the main strip to the first portion of the auxiliary strip, the first portion of the auxiliary strip being directly attached to the first portion of the main strip by means of the adhesive; first coating means, disposed on at least one of: the first surface of the main strip, and the first surface of the auxiliary strip, for selectively permitting, along the second portion of the auxiliary strip and the second portion of the the main strip, separation of the second portion of the auxiliary strip and the second portion of the main strip from each other; the first coating means providing at least some adhesion between the second section of the auxiliary strip and the second section of the main strip; the main strip having a third portion separate from the first portion of the main strip and the second portion of the main strip; the first coating means being disposed on at least one of the second portion of the main strip and the third portion of the main strip having an adhesive coating, the first coating means being configured to attach the second portion of the main strip and the third portion of the main strip to each other; and the adhesive providing a substantially stronger degree of adhesion between the first portion of the main strip and the first portion of the auxiliary strip than is provided by the first coating means between the second portion of the main strip and the second portion of the auxiliary strip.

BRIEF DESCRIPTION OF THE DRAWINGS

Additional advantages are explained below in greater detail, with reference to one embodiment which is illustrated in the accompanying drawings, wherein.

DESCRIPTION OF THE PREFERRED EMBODIMENT

Figure 1:
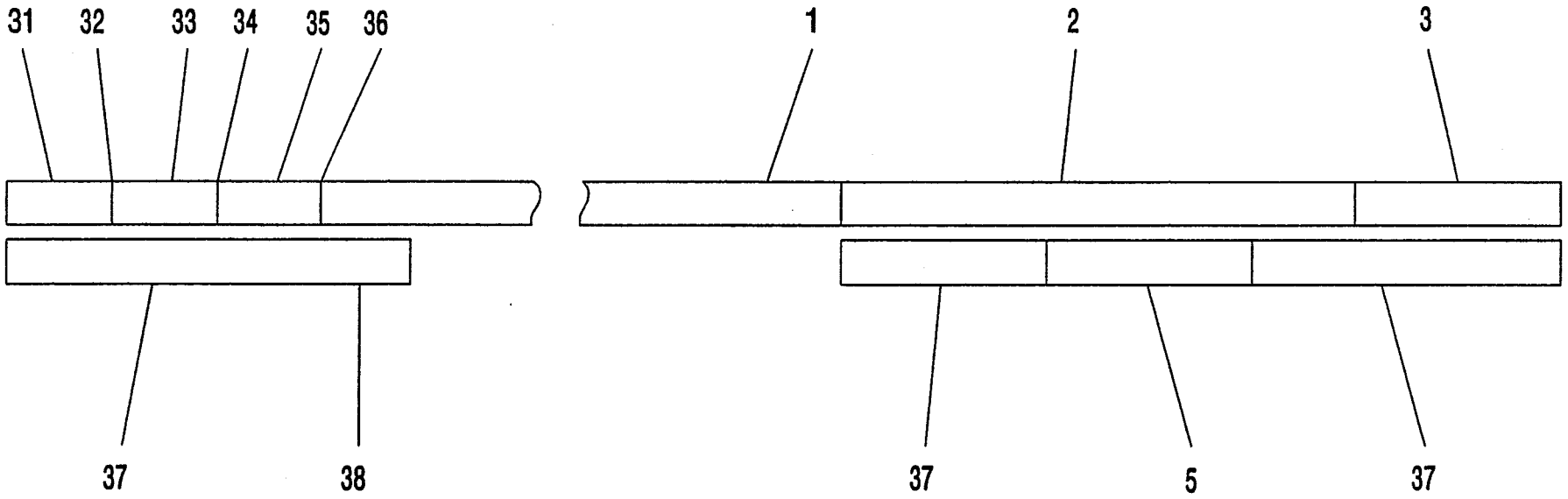
FIG. 1 shows a side view of the marking strip according to the invention.

FIG. 1 is a schematic diagram of a marking strip 1 from the side. The marking strip 1 essentially consists of a main part 2 and an adjacent control section 3 which extends in the longitudinal direction, to the right in FIG. 1. The control section 3 and the main part are preferably separated from one another by a parting cut 4. On the end opposite the control section 3, to the left in the drawing, there are preferably three small additional control segments 31, 33 and 35, also separated by parting cuts 32, 34 and 36.

Figure 1A:
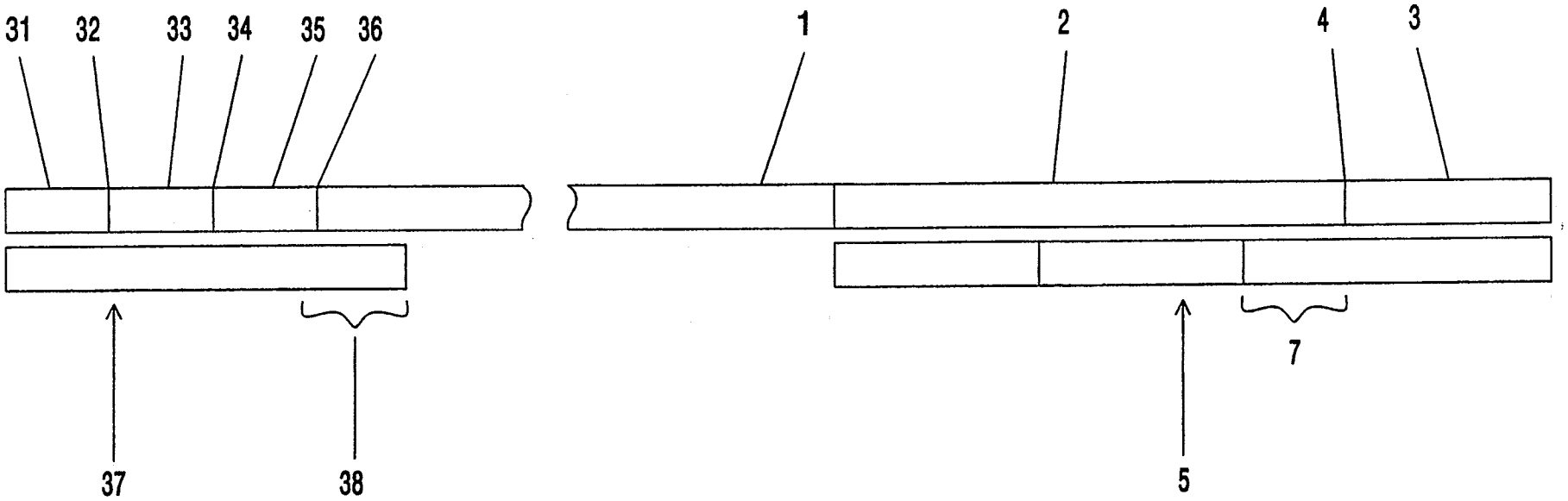
FIG. 1*a* shows essentially the same view as FIG. 1 but contains additional reference numerals.

FIG. 1*a* essentially the same view as FIG. 1, but more particularly references certain elements of the present invention. Particularly, FIG. 1*a* shows parting cut 4, which essentially serves to delineate main part 2 from control section 3, and gap or space 7, which will be described more fully below.

The marking strip 1, on its reverse side in the areas of the control segments 3, 31, 33 and 35, preferably has an adhesive coating. This adhesive coating is protected from drying out by a backing or auxialiary strip, indicated at 5 and 37, coated with silicone. The provision of the silicone coating essentially means that the backing strip is not firmly connected to the adhesive coating, but can be easily pulled away to expose the adhesive. But so that the backing strip 5 cannot be completely pulled off, the backing strip 5 preferably has a strongly-adhering, or strongly adhesive, area 6, which is indicated by the cross- hatched areas in FIG. 2. The strongly adhesive area 6 is preferably completely free of silicone, i.e. during the coating of the backing strip 5 with silicone, this strongly adhesive area 6 is preferably simply skipped. But if this is not possible for manufacturing reasons, or if it is too expensive, the silicone coating in the strongly adhesive area 6 can also be neutralized, corona-treated or roughened, or otherwise made inactive.

The strongly adhesive area 6 of the backing strip 5 is preferably located behind the main part 2 so that there is a space 7 between it and the parting cut 4. The silicone coating of the backing strip 5 is therefore essentially effective behind the control section 3 and the space 7. A long, silicone-coated section 8 is also preferably formed on the backing strip 5, and is preferably located on the end of the backing strip away from the control section. The length of the long section 8 is preferably approximately equal to the length of the strongly adhesive area 6.

Figure 2:
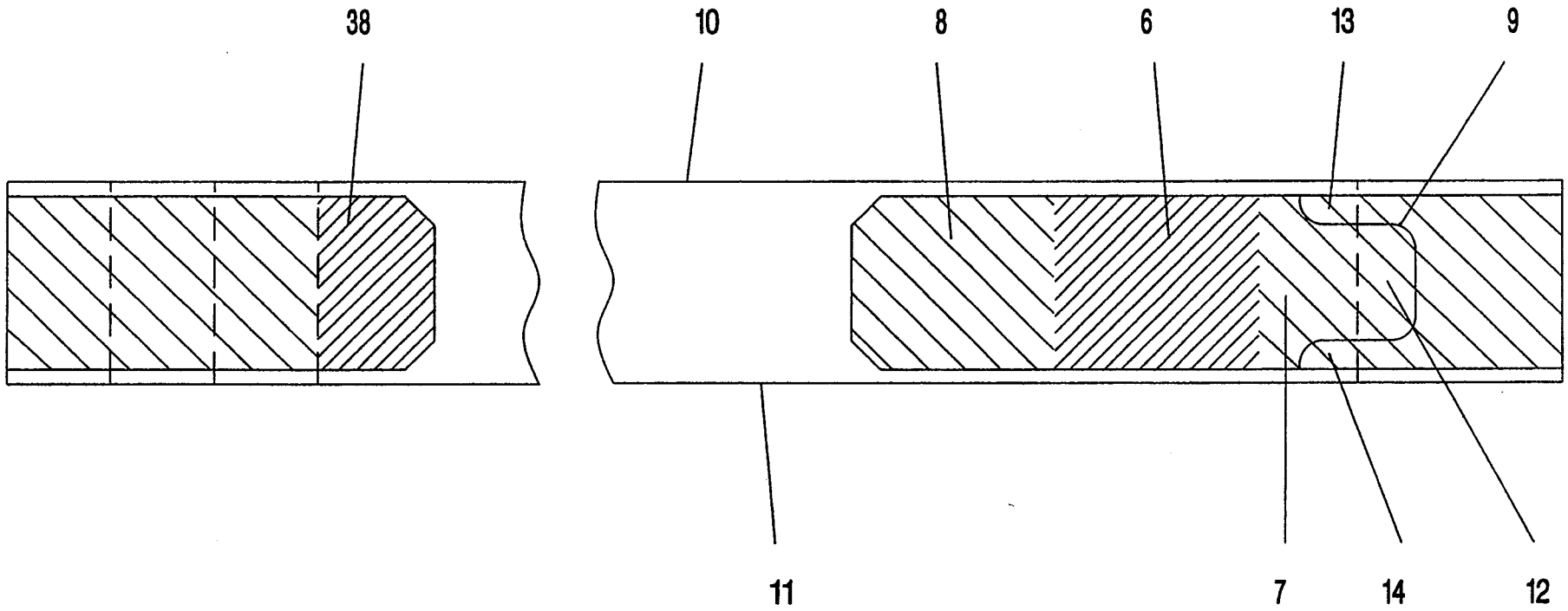
FIG. 2 shows a view from the underside of the marking strip illustrated in FIG. 1.
Figure 2A:
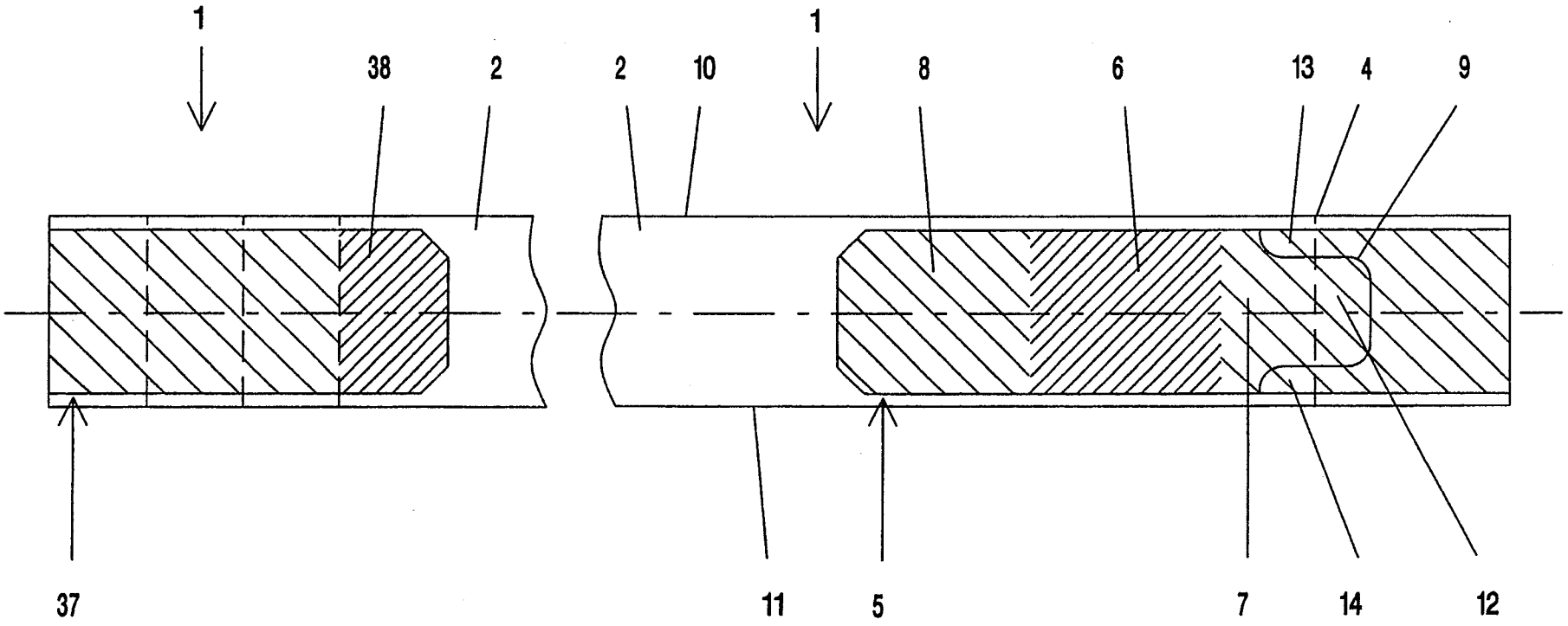
FIG. 2*a* shows essentially the same view as FIG. 2 but contains additional reference numerals.

FIG. 2*a* shows essentially the same view as FIG. 2, but more particularly illustrates certain elements of the present invention. Particularly, additionally referenced in FIG. 2*a* are marking strip 1, main part 2, control section 3, backing strip 5 and backing strip 37.

To more particularly illustrate the relative positioning of strongly adhesive area 6 with respect to main part 2 and control section 3, attention is directed to FIGS. 1, 1*a*, 2 and 2*a*. As illustrated therein, when viewed from right to left, marking strip 1 preferably includes control section 3, followed by main part 2, wherein control section 3 and main part 2 are separated by parting cut 4. The underlying backing strip 5 preferably includes a first silicone-coated section, followed by strongly adhesive area 6. As shown, preferably, strongly adhesive area 6 is essentially adhesively and connectingly interfaced with main part 2. In this manner, a leading edge of strongly adhesive area 6, that is, an edge towards the right of the drawings, is essentially disposed away from parting cut 4 over a distance covered by space or gap 7. Progressing still further to the left in the drawings, backing strip 5 is preferably further embodied by a generally long silicone-coated section 8. Thus, effectively, strongly adhesive area 6 is essentially preferably flanked by two silicone-coated sections, one of which is indicated at 8 in FIGS. 2 and 2*a* and the other of which is essentially disposed to the right of strongly adhesive area 6, as shown in FIGS. 2 and 2*a*. As stated above, the length of the long, silicone-coated section 8 is preferably approximately equal to the length of the strongly adhesive area 6. It should be understood that the silicone-coated sections just described, including section 8, may be considered as being "adhesive-repellent".

As shown in FIGS. 2 and 2*a*, an additional parting line 9 is preferably formed in the backing strip 5. This parting line 9 preferably begins at the lateral edge 10 of the marking strip 1, and/or at a similar lateral edge of backing strip 5, in the space 7 near the strongly adhesive area 6. It then may run in a curve in relation to the longitudinal direction toward the parting cut 4, and cross the parting cut 4, so that behind the control section 3, after a curve, it again may run at a right angle to the marking strip toward the opposite edge. Before the parting line 9 reaches the opposite edge 11, it again preferably turns toward the main part 2, and thereby once again may cross the parting cut 4. The curves of the parting line are preferably symmetrical in the longitudinal direction of the marking strip 1, in relation to the center line (shown in FIG. 2*a*). In other words, the curves of parting line 9 preferably exhibit symmetry with respect to the longitudinal center line of marking strip 1. Between the parting line 9 and the parting cut 4, behind the control section 3, a pocket 12 is thus essentially formed, while corner surfaces 13 and 14 are defined, as shown, behind the main part 2.

The main part 2 and the control section 3 are preferably held together by the backing strip 5. Likewise, the small control sections 31, 33 and 35 are preferably held on the main part by the backing strip 37 which extends to the main part. The backing strip 37 is preferably completely coated with silicone behind the small control sections 31, 33 and 35, while behind the main part 2 it preferably has a strongly adhesive area, so that, essentially, only the small control sections can be separated, but the backing 37 cannot be separated from the main part 2. It should be understood that, within the scope of the present invention, parting cut 4 may be embodied by any of several different types of cuts, including a perforated cut or a complete cut.

Thus, preferably, in accordance with a preferred embodiment of the present invention, there is preferably a second strongly adhesive area, indicated at 38 in FIG. 2, which, similarly to the strongly adhesive area 6 already described, preferably serves to firmly and adhesively interface backing strip 37 with main part 2 but not with control sections 31, 33 and 35. Preferably, the second strongly adhesive area 38 is formed in a manner similar to that of the strongly adhesive area 6. Thus, that portion of backing strip 37 which is interfaceable with control sections 31, 33 and 35 in a manner similar to that already described for that portion of strip 1 disposed to the right in FIGS. 1, 1*a*, 2 and 2*a*, is preferably capable of being selectively peeled away from and readhered to control sections 31, 33 and 35.

Essentially, it should be apparent that for continuous manufacture of the marking strip 1, the backing strip 37 of a first marking strip can essentially be located directly behind the backing strip 5 of a second marking strip. Alternatively, for continuous manufacture, the backing strip 5 of a first marking strip can essentially be located directly behind the backing strip 37 of second marking strip. The various marking strips 1 and backing strips 5 and 37 essentially need only be separated from one another by a common perforation. They can then be wound up continuously or accordion-folded, and fed to a printer before their use.

Immediately before they are used, the marking strips 1, can preferably be printed with identification data, e.g. by means of a thermo-printer. After a marking strip 1 has been removed from the printer, and, essentially, when the strip is being used, the control section 3 is preferably pulled away from the main part 2 at the parting cut 4. Preferably, the backing strip 5 thence essentially comes apart at the parting line 9. Behind the control section 3, the adhesive coating is thus essentially exposed along the pocket 12. The control section can then be glued to an airline ticket without having to pull off the rest of the backing strip 5.

Figure 3:
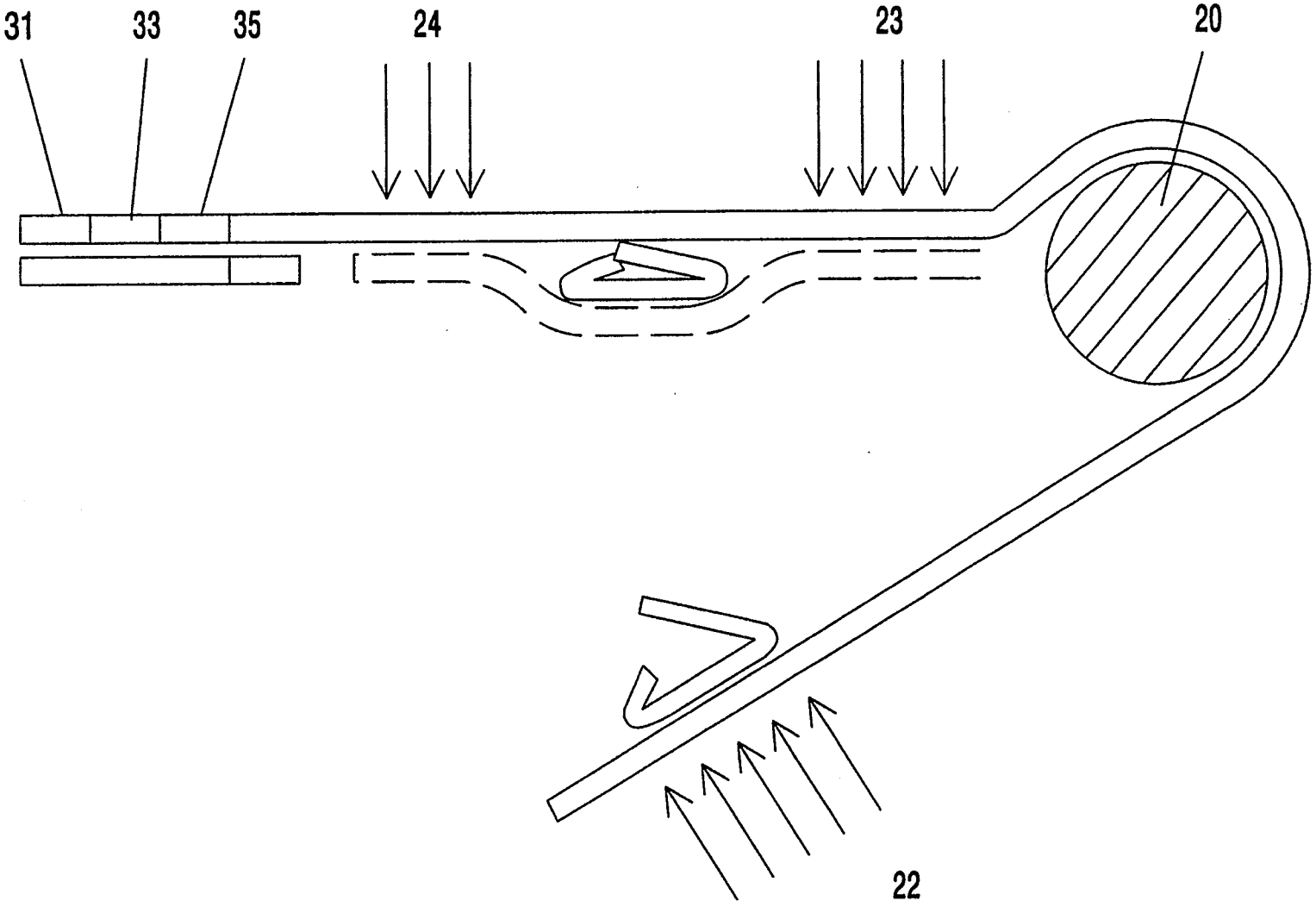
FIG. 3 shows a side view of the main part of the marking strip illustrated in FIGS. 1 and 2 as it is glued around a suitcase handle.
Figure 3A:
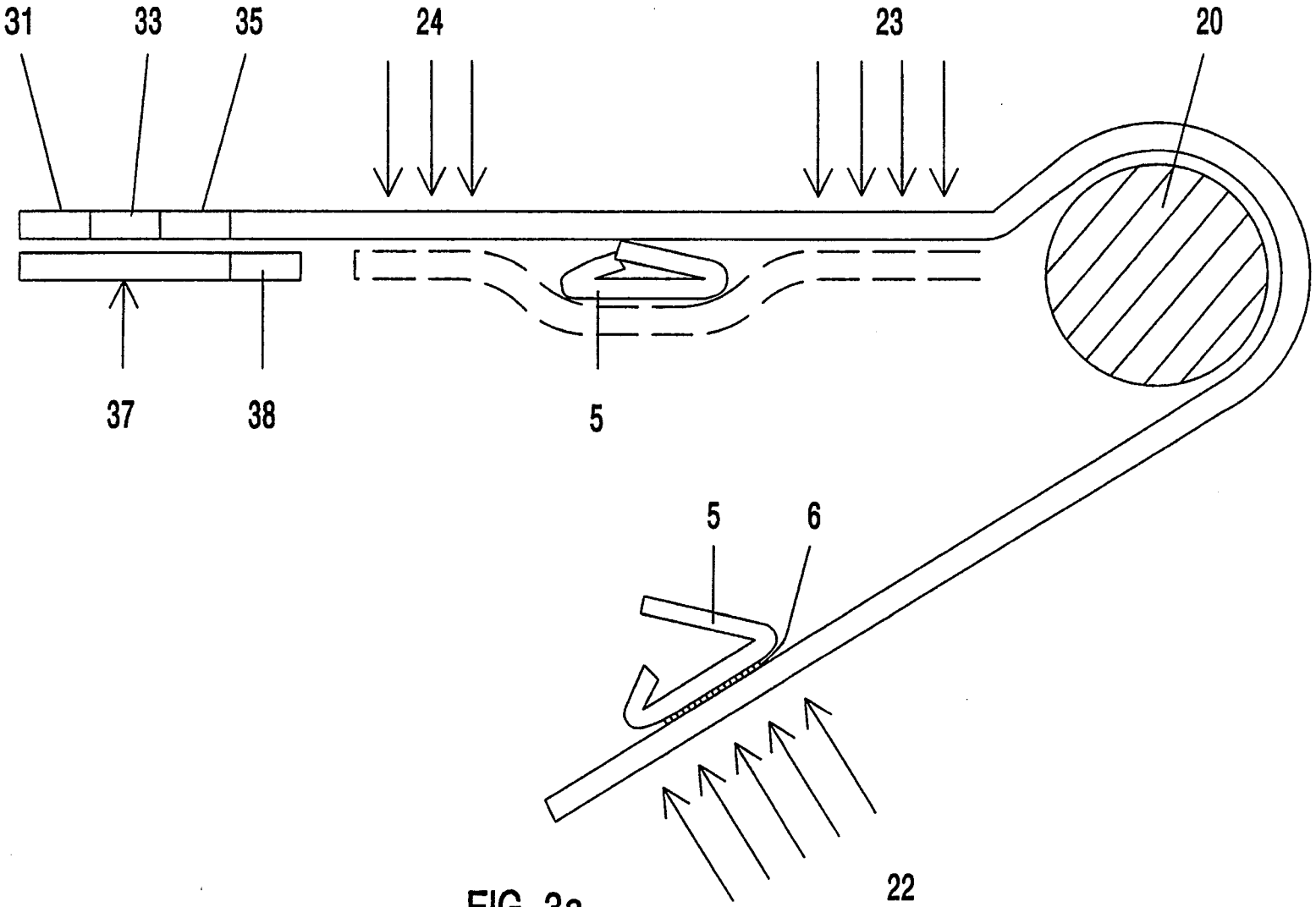
FIG. 3*a* shows essentially the same view as FIG. 3 but contains additional reference numerals.

Then the main part 2, as shown in FIG. 3, is preferably looped around one handle 20 of a piece of luggage. Arrow 22 shows where the strongly adhesive area 6 of the backing strip 5 is located at this stage. First, the end of backing strip 5 can be folded from the narrow space 7 toward the strongly adhesive area 6, and then the long section 8 of backing strip 5 can also be folded to the strongly adhesive area 6. Then the lower end of the marking strip 1 can preferably be pressed with its reverse side against the reverse side of the upper end thereof behind the backing strip 37, and the strip can thus be glued together. The surfaces to which the marking strip is glued, in accordance with the present embodiment of the invention, are indicated by arrows 23 and 24. FIG. 3 shows that the marking strip is essentially fixed by a small adhesive surface on its ends, and immediately behind the suitcase handle 20 forms a closed loop around the suitcase handle 20 with a generally large adhesive surface.

It should also be noted that it is generally not absolutely essential for the end of the backing strip to be folded from the narrow space 7 to the strongly adhesive area 6. When the control section 3 is torn off, the corner surfaces 13 and 14 are already exposed at the space 7. It is also sufficient to fix the end of the marking strip by gluing it only at the corner surfaces 13 and 14.

Thus, essentially, in accordance with a preferred embodiment of the present invention, a parting line 9 can be provided in such a way that, when control section 3 is torn off, there will essentially remain two areas 13 and 14 which are not covered by any portion of backing strip 5. In this way, there will essentially be exposed adhesive material at areas 13 and 14 and, consequently, it will be possible to fold over one end of marking strip 1 onto another end thereof and adhere those ends to one another without any need for peeling or folding back any portion of backing strip 5.

In accordance with the present invention, after undertaking the steps as generally outlined hereinabove, the small control sections 31, 33 and 35 will essentially be located on the end of the loop formed around the suitcase handle 20. During transport, these control strips can be removed and used for documentation of the transport route, for billing purposes, etc. The backing strip 37 also essentially remains firmly connected to the main part 2 of the marking strip. There is essentially no waste to be disposed of locally. The permanent connection of the backing strip 37 is also important if the end of the main part 2 of marking strip 1 is not glued behind the backing strip 37, as shown in FIG. 3, but on top of the backing strip 37. Even then the loop remains firmly closed, because the backing strip 5 essentially cannot come loose from the main part.

It should also be noted that the small control sections 31, 33 and 35 can also essentially be eliminated. Generally, these control sections are only provided if necessary, and tend not to constitute an essential component of the invention. They essentially perform a supplemental function, which the invention makes possible for the first time without significant disadvantages.

One feature of the invention resides broadly in the marking strip with a main part and a control section adjacent to it in the longitudinal direction, separated by a parting cut, whereby the control section and an adjacent area of the main part have an adhesive coating on the reverse side which is covered by a silicone-coated backing strip, which is firmly connected to the main part and is interrupted at some distance from the parting cut of the label strip at a parting line, characterized by the fact that the backing strip 5, in the vicinity of the main part 2, has a strongly adhesive area 6 on its side facing the main part 2.

Another feature of the invention resides broadly in the marking strip, characterized by the fact that the strongly adhesive area 6 is created by interrupting the silicone coating.

Yet another feature of the invention resides broadly in the marking strip, characterized by the fact that in the strongly adhesive area 6, the silicone coating is neutralized or covered by an adhesive coating.

Still yet another feature of the invention resides broadly in the marking strip, characterized by the fact that to neutralize the silicone coating in the strongly adhesive area 6, the silicone coating is etched or corona-treated, or roughened.

Another feature of the invention resides broadly in the marking strip, characterized by the fact that the strongly adhesive area 6 extends in the longitudinal direction over the entire width of the backing strip 5.

Still another feature of the invention resides broadly in the marking strip, characterized by the fact that the strongly adhesive area 6 is located in the longitudinal direction so that between the strongly adhesive area 6 and the parting cut 4, there is a narrow space 7 pointing toward the control section 3, which is adhesive-repellent on account of the silicone coating, and that a long, adhesive-repellent section 8 is formed in the opposite direction.

Yet another feature of the invention resides broadly in the marking strip, characterized by the fact that the longitudinal extension of the long, adhesive-repellent section 8 is approximately equal to the length of the strongly adhesive area 6.

Another feature of the invention resides broadly in the marking strip, characterized by the fact that the parting line 9 in the backing strip 5 crosses the parting cut 4 between the main part 2 and the control section 3 at least once.

Still yet another feature of the invention resides broadly in the marking strip, characterized by the fact that the parting line 9 begins at the lateral edge of the marking strip 1 behind the main part 2, at right angles to the marking strip 1, then intersects the parting cut 4 in a curve, and runs parallel to the parting cut 4 behind the control section 3, and then, before reaching the other lateral edge, once again crosses the parting cut 4 approaching the main part 2 in a curve.

Examples of silicone coatings, which may utilized in accordance with the embodiments of the present invention, may be found in the following U.S. Pat. No. 5,183,696, which issued to Sanderson on Feb. 2, 1993; No. 4,938,414, which issued to Lippert on Jul. 3, 1990; and No. 4,867,828, which issued to McIntyre on Sep. 19, 1989.

Examples of adhesive coatings, which may be utilized in accordance with the embodiments of the present invention, may be found in the following U.S. Pat. No. 4,726,972, which issued to Instance on Feb. 23, 1988; and No. 4,065,343, which issued to Stumpe on Dec. 27, 1977.

Example of neutralizing processes, which may be utilized in accordance with the embodiments of the present invention, may be found in the following U.S. Pat. No. 4,929,691, which issued to Fillmore et al. on May 29, 1990; and No. 4,923,755, which issued to Witucki on May 8, 1990.

Examples of corona treatments, etching processes and roughening processes, which may be utilized in accordance with the embodiments of the present invention, may be found in the following U.S. Pat. No. 5,114,514, which issued to Landis on May 19, 1992; No. 4,716,068, which issued to Walter et al. on Dec. 29, 1987; and No. 4,247,361, which issued to Shaheen on Jan. 27, 1981.

Examples of oxidizing printing inks, which may be utilized in accordance with the embodiments of the present invention, may be found in the following U.S. Pat. No. 5,159,353, which issued to Fasen et al. on Oct. 27, 1992; No. 5,121,131, which issued to Bouldin et al. on Jun. 9, 1992; and No. 5,053,078, which issued to Koike et al. on Oct. 1, 1991.

Examples of thermoprinter arrangements, which may be utilized in accordance with the embodiments of the present invention, may be found in the following U.S. Pat. No. 4,805,531, which issued to Sarda on Feb. 21, 1989; No. 4,792,246, which issued to Van Pelt on Dec. 20, 1988; and No. 4,587,411, which issued to Obstfelder et al. on May 6, 1986.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A method of marking checked airline luggage by means of an airline luggage marking strip, by wrapping the marking strip around a handle of the airline luggage, said method comprising the steps of:

providing an airline luggage marking strip by way of the following steps:

providing a main strip for being wrapped around the handle of the airline luggage, the main strip comprising a first surface on a first side of the main strip and a second surface on a second side of the main strip, the first side of the main strip being disposed opposite the second side of the main strip;

providing an auxiliary strip for being partially removed to permit the wrapping of the main strip around the handle of the airline luggage, the auxiliary strip comprising a first surface on a first side of the auxiliary strip and a second surface on a second side of the auxiliary strip, the first side of the auxiliary strip being disposed opposite the second side of the auxiliary strip;

configuring the first surface of the auxiliary strip to have a first portion and a second portion;

configuring the first surface of the main strip to have a first portion and a second portion;

providing an adhesive for attaching the first portion of the main strip to the first portion of the auxiliary strip;

directly attaching the first portion of the main strip to the first portion of the auxiliary strip by means of the adhesive;

providing first coating means and disposing the first coating means on at least one of:

the first surface of the main strip, and the first surface of the auxiliary strip, to selectively permit, along the second portion of the auxiliary strip and the second portion of the main strip, separation of the second portion of the auxiliary strip and the second portion of the main strip from each other;

configuring the first coating means to provide at least some adhesion between the second portion of the auxiliary strip and the second portion of the main strip;

configuring the main strip to have a third portion separate from the first portion of the main strip and the second portion of the main strip;

disposing the first coating means on at least one of the second portion of the main strip and the third portion of the main strip;

configuring the first coating means to attach the second portion of the main strip and the third portion of the main strip to each other; and configuring the adhesive to provide a substantially stronger degree of adhesion between the first portion of the main strip and the first portion of the auxiliary strip than is provided by the first coating means between the second portion of the main strip and the second portion of the auxiliary strip;

providing a substantially stronger degree of adhesion between the first portion of the main strip and the first portion of the auxiliary strip than between the second portion of the main strip and the second portion of the auxiliary strip;

said method further comprising the additional steps of:

separating the second portion of the auxiliary strip and the second portion of the main strip from each other along the second portion of the auxiliary strip and the second portion of the main strip;

wrapping the main strip around the handle of the airline luggage; and said step of wrapping comprising the step of attaching the second portion of the main strip and the third portion of the main strip to each other by means of the first coating means.

2. The method according to claim 1, further comprising the steps of:

configuring the first coating means to comprise:

an adhesive coating disposed on one of:

the first surface of the main strip, and the first surface of the auxiliary strip; and an adhesive-repellent coating disposed on the other of:

the first surface of the main strip, and the first surface of the auxiliary strip;

disposing the adhesive coating on one of:

the first surface of the main strip, and the first surface of the auxiliary strip; and disposing the adhesive-repellent coating disposed on the other of:

the first surface of the main strip, and the first surface of the auxiliary strip.

3. The method according to claim 2, further comprising the steps of:

disposing the adhesive coating on the first surface of the main strip; and disposing the adhesive-repellent coating on the first surface of the auxiliary strip.

4. The method according to claim 3, further comprising the step of:

configuring the adhesive to comprise an adhesive coating disposed on the first portion of the main strip, and disposing that adhesive coating on the first portion of the main strip.

5. The method according to claim 4, further comprising the step of:

configuring the adhesive to further comprise one of:

the adhesive-repellent coating being absent from the first portion of the auxiliary strip;

the adhesive-repellent coating being disposed on the first portion of the auxiliary strip and being neutralized there; and the adhesive-repellent coating being disposed on the first portion of the auxiliary strip and itself having a supplementary adhesive coating being disposed thereupon;

performing one of the following steps:

configuring the first portion of the auxiliary strip to lack the adhesive-repellent coating;

disposing the adhesive-repellent coating on the first portion of the auxiliary strip and being neutralized there; and disposing the adhesive-repellent coating on the first portion of the auxiliary strip and itself having a supplementary adhesive coating being disposed thereupon.

6. The method according to claim 5, further comprising the step of configuring the first portion of the main strip to be contiguous with the second portion of the main strip.

7. The method according to claim 6, further comprising the steps of:

configuring the marking strip such that:

the adhesive-repellent coating comprises silicone;

the neutralized adhesive-repellent coating comprises one of:

an etched coating;

a corona-treated coating; and a roughened coating;

the first portion of the auxiliary strip is contiguous with the second portion of the auxiliary strip;

the main strip comprises a primary section and a control section, the primary section and the control section being disposed contiguously adjacent one another;

the first portion of the main strip is entirely in the primary section;

the second portion of the main strip comprises a portion of the primary section and all of the control section;

the second portion of the auxiliary strip is configured to interface with the second portion of the main strip;

the primary section and the control section of the main strip are separated from one another by a parting cut;

the parting cut comprises one of:

a perforated cut; and a clean cut;

the marking strip has a longitudinal dimension and a transverse dimension;

the auxiliary strip has a width, the width being defined parallel to the transverse dimension of the marking strip;

the adhesive coating extends transversely over the main strip over a distance equivalent to at least the width of the auxiliary strip;

the adhesive coating has a longitudinal extent along the longitudinal dimension of the marking strip;

the first portion of the auxiliary strip is separated from the parting cut by a substantial distance;

the first portion of the auxiliary strip is separated from the parting cut by a distance equivalent to about one-half the longitudinal extent of the adhesive coating;

the second portion of the auxiliary strip comprises a first part and a second part;

both of the first part and the second part are longitudinally contiguous with, and separated by, the first portion of the auxiliary strip;

the second portion of the main strip comprises a first part and a second part;

both of the first part and the second part are longitudinally contiguous with, and separated by, the first portion of the main strip;

the first part of the second portion of the main strip comprises all of the control section and a portion of the primary section;

the first part of the second portion of the auxiliary strip is configured to interface with the first part of the second portion of the main strip;

the second part of the second portion of the auxiliary strip has a longitudinal extent approximately equivalent to that of the first portion of the auxiliary strip;

the marking strip comprises a parting line;

the parting line is configured to divide the auxiliary strip into two working portions and to render the auxiliary strip separable into the two working portions;

the parting line is separated from the first portion of the auxiliary strip by a substantial distance;

the parting line is configured to cross the parting cut at least once;

the parting line:

begins at a first lateral edge of the auxiliary strip, between the parting cut and the first section of the auxiliary strip;

proceeds, a distance less than about one fourth of the width of the auxiliary strip, in a direction parallel to the transverse dimension of the marking strip;

turns, through an arc of about 90°, towards the parting cut;

proceeds, in a direction parallel to the longitudinal dimension of the marking strip, past the parting cut and, after a distance less than about one half the longitudinal extent of the control section, turns, through an arc of about 90°, back towards the parting cut;

proceeds, in a direction parallel to the longitudinal dimension of the marking strip, past the parting cut, turns, through an arc of about 90°, towards an opposite lateral edge of the auxiliary strip; and terminates at the opposite lateral edge of the auxiliary strip, at a point generally opposite from where the parting line begins;

the main strip comprises three additional control sections;

the three additional control sections are disposed adjacent the primary section;

the primary section and the three additional control sections are longitudinally contiguous and being separated at a second parting cut;

a first of the three additional control sections is longitudinally contiguous with the primary section and being separated from the primary section at the second parting cut;

a second of the three additional control sections is longitudinally contiguous with the first additional control section and being separated from the first additional control section at a third parting cut;

a third of the three additional control sections is longitudinally contiguous with the second additional control section and being separated from the second additional control section at a fourth parting cut;

the marking strip comprises a second auxiliary strip;

a first portion of the second auxiliary strip is adhesively attached to the primary section of main strip;

a second portion of the second auxiliary strip is for being interfaced with the three additional control sections; and the second auxiliary strip comprises the adhesive-repellent coating for selectively permitting, along the second portion of the second auxiliary strip, separation of the second portion of the second auxiliary strip and the three additional control sections from each other.

8. Airline luggage marking strip for marking checked airline luggage by being wrapped around a handle of the luggage, said marking strip comprising:

a main strip for being wrapped around the handle of the airline luggage, said main strip comprising a first surface on a first side of said main strip and a second surface on a second side of said main strip, the first side of said main strip being disposed opposite the second side of the main strip;

an auxiliary strip for being at least partially removed to permit the wrapping of the main strip around the airline luggage handle, said auxiliary strip comprising a first surface on a first side of said auxiliary strip and a second surface on a second side of said auxiliary strip, the first side of said auxiliary strip being disposed opposite the second side of said auxiliary strip;

said first surface of said auxiliary strip having a first portion and a second portion;

said first surface of said main strip having a first portion and a second portion;

an adhesive attaching said first portion of said main strip to said first portion of said auxiliary strip, said first portion of said auxiliary strip being directly attached to said first portion of said main strip by means of said adhesive;

first coating means, disposed on at least one of:

said first surface of said main strip, and said first surface of said auxiliary strip, for selectively permitting, along said second portion of said auxiliary strip and said second portion of said said main strip, separation of said second portion of said auxiliary strip and said second portion of said main strip from each other;

said first coating means providing at least some adhesion between said second portion of said auxiliary strip and said second portion of said main strip;

said main strip having a third portion separate from said first portion of said main strip and said second portion of said main strip;

said first coating means being disposed on at least one of said second portion of said main strip and said third portion of said main strip, said first coating means being configured to attach said second portion of said main strip and said third portion of said main strip to each other such that the main strip is disposed around the handle of the airline luggage; and said adhesive providing a substantially stronger degree of adhesion between said first portion of said main strip and said first portion of said auxiliary strip than is provided by said first coating means between said second portion of said main strip and said second portion of said auxiliary strip.

9. The airline luggage marking strip according to claim 8, wherein said first coating means comprises:

an adhesive coating disposed on one of:

said first surface of said main strip, and said first surface of said auxiliary strip; and an adhesive-repellent coating disposed on the other of:

said first surface of said main strip, and said first surface of said auxiliary strip.

10. The airline luggage marking strip according to claim 9, wherein:

said adhesive coating is disposed on said first surface of said main strip; and said adhesive-repellent coating is disposed on said first surface of said auxiliary strip.

11. The airline luggage marking strip according to claim 10, wherein said adhesive comprises an adhesive coating disposed on said first portion of said main strip.

12. The airline luggage marking strip according to claim 11, wherein said adhesive further comprises one of:

said adhesive-repellent coating being absent from the first portion of said auxiliary strip;

said adhesive-repellent coating being disposed on the first portion of said auxiliary strip and being neutralized there; and said adhesive-repellent coating being disposed on the first portion of said auxiliary strip and itself having a supplementary adhesive coating being disposed thereupon.

13. The airline luggage marking strip according to claim 12, wherein said first portion of said main strip is contiguous with said second portion of said main strip.

14. The airline luggage marking strip according to claim 13, further comprising:

said adhesive-repellent coating comprising silicone;

said neutralized adhesive-repellent coating comprising one of:

an etched coating;

a corona-treated coating; and a roughened coating;

said first portion of said auxiliary strip being contiguous with said second portion of said auxiliary strip;

said main strip comprising a primary section and a control section, said primary section and said control section being disposed contiguously adjacent one another;

said first portion of said main strip being entirely in said primary section;

said second portion of said main strip comprising a portion of said primary section and all of said control section;

said second portion of said auxiliary strip being configured to interface with said second portion of said main strip;

said primary section and said control section of said main strip being separated from one another by a parting cut;

said parting cut comprising one of:

a perforated cut; and a clean cut;

said marking strip has a longitudinal dimension and a transverse dimension;

said auxiliary strip has a width, the width being defined parallel to the transverse dimension of said marking strip;

said adhesive coating extends transversely over said main strip over a distance equivalent to at least the width of said auxiliary strip;

said adhesive coating having a longitudinal extent along the longitudinal dimension of said marking strip;

said first portion of said auxiliary strip being separated from said parting cut by a substantial distance;

said first portion of said auxiliary strip being separated from said parting cut by a distance equivalent to about one-half the longitudinal extent of said adhesive coating;

said second portion of said auxiliary strip comprising a first part and a second part;

both of said first part and said second part being longitudinally contiguous with, and separated by, said first portion of said auxiliary strip;

said second portion of said main strip comprising a first part and a second part;

both of said first part and said second part being longitudinally contiguous with, and separated by, said first portion of said main strip;

said first part of said second portion of said main strip comprising all of said control section and a portion of said primary section;

said first part of said second portion of said auxiliary strip being configured to interface with said first part of said second portion of said main strip;

said second part of said second portion of said auxiliary strip having a longitudinal extent approximately equivalent to that of said first portion of said auxiliary strip;

a parting line;

said parting line being configured to divide said auxiliary strip into two working portions and to render said auxiliary strip separable into said two working portions;

said parting line being separated from said first portion of said auxiliary strip by a substantial distance;

said parting line being configured to cross said parting cut at least once;

said parting line:

begins at a first lateral edge of said auxiliary strip, between said parting cut and said first section of said auxiliary strip;

proceeds, a distance less than about one fourth of the width of the auxiliary strip, in a direction parallel to the transverse dimension of the marking strip;

turns, through an arc of about 90°, towards said parting cut;

proceeds, in a direction parallel to the longitudinal dimension of the marking strip, past the parting cut and, after a distance less than about one half the longitudinal extent of the control section, turns, through an arc of about 90°, back towards said parting cut;

proceeds, in a direction parallel to the longitudinal dimension of the marking strip, past the parting cut, turns, through an arc of about 90°, towards an opposite lateral edge of said auxiliary strip; and terminates at the opposite lateral edge of the auxiliary strip, at a point generally opposite from where said parting line begins;

said main strip comprising three additional control sections;

said three additional control sections being disposed adjacent said primary section;

said primary section and said three additional control sections being longitudinally contiguous and being separated at a second parting cut;

a first of said three additional control sections being longitudinally contiguous with said primary section and being separated from said primary section at said second parting cut;

a second of said three additional control sections being longitudinally contiguous with said first additional control section and being separated from said first additional control section at a third parting cut;

a third of said three additional control sections being longitudinally contiguous with said second additional control section and being separated from said second additional control section at a fourth parting cut;

a second auxiliary strip;

a first portion of said second auxiliary strip being adhesively attached to said primary section of main strip;

a second portion of said second auxiliary strip for being interfaced with said three additional control sections; and said second auxiliary strip comprising said adhesive-repellent coating for selectively permitting, along said second portion of said second auxiliary strip, separation of said second portion of said second auxiliary strip and said three additional control sections from each other.

15. Marking strip for the identification of an object, such as luggage, said strip comprising:

a main strip, said main strip comprising a first surface on a first side of said main strip and a second surface on a second side of said main strip, the first side of said main strip being disposed opposite the second side of the main strip;

an auxiliary strip, said auxiliary strip comprising a first surface on a first side of said auxiliary strip and a second surface on a second side of said auxiliary strip, the first side of said auxiliary strip being disposed opposite the second side of said auxiliary strip;

said first surface of said auxiliary strip having a first portion and a second portion;

said first surface of said main strip having a first portion and a second portion;

an adhesive attaching said first portion of said main strip to said first portion of said auxiliary strip, said first portion of said auxiliary strip being directly attached to said first portion of said main strip by means of said adhesive;

first coating means, disposed on at least one of:

said first surface of said main strip, and said first surface of said auxiliary strip, for selectively permitting, along said second portion of said auxiliary strip and said second portion of said said main strip, separation of said second portion of said auxiliary strip and said second portion of said main strip from each other;

said first coating means providing at least some adhesion between said second section of said auxiliary strip and said second section of said main strip;

said main strip having a third portion separate from said first portion of said main strip and said second portion of said main strip;

said first coating means being disposed on at least one of said second portion of said main strip and said third portion of said main strip having an adhesive coating, said first coating means being configured to attach said second portion of said main strip and said third portion of said main strip to each other; and said adhesive providing a substantially stronger degree of adhesion between said first portion of said main strip and said first portion of said auxiliary strip than is provided by said first coating means between said second portion of said main strip and said second portion of said auxiliary strip.

16. The marking strip according to claim 15, wherein said first coating means comprises:

an adhesive coating disposed on one of:

said first surface of said main strip, and said first surface of said auxiliary strip; and an adhesive-repellent coating disposed on the other of:

said first surface of said main strip, and said first surface of said auxiliary strip.

17. The marking strip according to claim 16, wherein:

said adhesive coating is disposed on said first surface of said main strip; and said adhesive-repellent coating is disposed on said first surface of said auxiliary strip.

18. The marking strip according to claim 17, wherein said adhesive comprises an adhesive coating disposed on said first portion of said main strip.

19. The marking strip according to claim 18, wherein said adhesive further comprises one of:

said adhesive-repellent coating being absent from the first portion of said auxiliary strip;

said adhesive-repellent coating being disposed on the first portion of said auxiliary strip and being neutralized there; and said adhesive-repellent coating being disposed on the first portion of said auxiliary strip and itself having a supplementary adhesive coating being disposed thereupon.

20. The marking strip according to claim 19, further comprising:

said first portion of said main strip being contiguous with said second portion of said main strip;

said adhesive-repellent coating comprising silicone;

said neutralized adhesive-repellent coating comprising one of:

an etched coating;

a corona-treated coating; and a roughened coating;

said first portion of said auxiliary strip being contiguous with said second portion of said auxiliary strip;

said main strip comprising a primary section and a control section, said primary section and said control section being disposed contiguously adjacent one another;

said first portion of said main strip being entirely in said primary section;

said second portion of said main strip comprising a portion of said primary section and all of said control section;

said second portion of said auxiliary strip being configured to interface with said second portion of said main strip;

said primary section and said control section of said main strip being separated from one another by a parting cut;

said parting cut comprising one of:

a perforated cut; and a clean cut;

said marking strip has a longitudinal dimension and a transverse dimension;

said auxiliary strip has a width, the width being defined parallel to the transverse dimension of said marking strip;

said adhesive coating extends transversely over said main strip over a distance equivalent to at least the width of said auxiliary strip;

said adhesive coating having a longitudinal extent along the longitudinal dimension of said marking strip;

said first portion of said auxiliary strip being separated from said parting cut by a substantial distance;

said first portion of said auxiliary strip being separated from said parting cut by a distance equivalent to about one-half the longitudinal extent of said adhesive coating;

said second portion of said auxiliary strip comprising a first part and a second part;

both of said first part and said second part being longitudinally contiguous with, and separated by, said first portion of said auxiliary strip;

said second portion of said main strip comprising a first part and a second part;

both of said first part and said second part being longitudinally contiguous with, and separated by, said first portion of said main strip;

said first part of said second portion of said main strip comprising all of said control section and a portion of said primary section;

said first part of said second portion of said auxiliary strip being configured to interface with said first part of said second portion of said main strip;

said second part of said second portion of said auxiliary strip having a longitudinal extent approximately equivalent to that of said first protion of said auxiliary strip;

a parting line;

said parting line being configured to divide said auxiliary strip into two working portions and to render said auxiliary strip separable into said two working portions;

said parting line being separated from said first portion of said auxiliary strip by a substantial distance;

said parting line being configured to cross said parting cut at least once;

said parting line:

begins at a first lateral edge of said auxiliary strip, between said parting cut and said first section of said auxiliary strip;

proceeds, a distance less than about one fourth of the width of the auxiliary strip, in a direction parallel to the transverse dimension of the marking strip;

turns, through an arc of about 90°, towards said parting cut;

proceeds, in a direction parallel to the longitudinal dimension of the marking strip, past the parting cut and, after a distance less than about one half the longitudinal extent of the control section, turns, through an arc of about 90°, back towards said parting cut;

proceeds, in a direction parallel to the longitudinal dimension of the marking strip, past the parting cut, turns, through an arc of about 90°, towards an opposite lateral edge of said auxiliary strip; and terminates at the opposite lateral edge of the auxiliary strip, at a point generally opposite from where said parting line begins;

said main strip comprising three additional control sections;

said three additional control sections being disposed adjacent said primary section;

said primary section and said three additional control sections being longitudinally contiguous and being separated at a second parting cut;

a first of said three additional control sections being longitudinally contiguous with said primary section and being separated from said primary section at said second parting cut;

a second of said three additional control sections being longitudinally contiguous with said first additional control section and being separated from said first additional control section at a third parting cut;

a third of said three additional control sections being longitudinally contiguous with said second additional control section and being separated from said second additional control section at a fourth parting cut;

a second auxiliary strip;

a first portion of said second auxiliary strip being adhesively attached to said primary section of main strip;

a second portion of said second auxiliary strip for being interfaced with said three additional control sections; and said second auxiliary strip comprising said adhesive-repellent coating for selectively permitting, along said second portion of said second auxiliary strip, separation of said second portion of said second auxiliary strip and said three additional control sections from each other.

* * * * *

UNITED STATES PATENT AND TRADEMARK OFFICE

CERTIFICATE OF CORRECTION

PATENT NO. : 5,357,702

DATED : October 25, 1994

INVENTOR(S) : Ton VAN TUIL and Jan SEEGERS

It is certified that error appears in the above-indentified patent and that said Letters Patent is hereby corrected as shown below:

In column 3, line 6, after 'parting', delete "cut" and insert --cut--.

In column 6, line 10, after 'or', delete "auxialiary" and insert --auxiliary--.

In column 10, line 5, before 'of' delete "Example" and insert --Examples--.

Signed and Sealed this

Tenth Day of September, 1996

*Attest:*

Bruce Lehman

BRUCE LEHMAN

*Attesting Officer*

*Commissioner of Patents and Trademarks*